US010539920B2

(12) United States Patent
Hamasaki et al.

(10) Patent No.: US 10,539,920 B2
(45) Date of Patent: Jan. 21, 2020

(54) IMAGE FORMING APPARATUS

(71) Applicant: CANON KABUSHIKI KAISHA, Tokyo (JP)

(72) Inventors: Ryuji Hamasaki, Tokyo (JP); Tetsuji Suzuki, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/256,014

(22) Filed: Jan. 24, 2019

(65) Prior Publication Data

US 2019/0227485 A1 Jul. 25, 2019

(30) Foreign Application Priority Data

Jan. 24, 2018 (JP) ..... 2018-009637

(51) Int. Cl.
*G03G 21/20* (2006.01)
*G03G 21/16* (2006.01)

(52) U.S. Cl.
CPC ..... *G03G 21/1623* (2013.01); *G03G 21/203* (2013.01)

(58) Field of Classification Search
CPC ..... G03G 21/1633
See application file for complete search history.

(56) References Cited

U.S. PATENT DOCUMENTS 4,523,807 A 6/1985 Suzuki
5,694,330 A 12/1997 Iwamura et al.
6,321,182 B1 11/2001 Suzuki
7,286,784 B2 * 10/2007 Tanaka ..... G03G 21/203 399/359
7,731,904 B2 6/2010 Okamoto et al.
8,311,438 B2 * 11/2012 Onuma ..... G03G 15/80 399/110
9,248,445 B2 2/2016 Okamoto et al.
10,343,432 B2 * 7/2019 Sasaki ..... B41J 29/377

FOREIGN PATENT DOCUMENTS

JP H11-130298 A 5/1999
JP 2001-320527 A 11/2001
JP 2007148067 A * 6/2007
JP 2010025960 A * 2/2010
JP 2010-169998 A 8/2010

* cited by examiner

*Primary Examiner* — Clayton E. LaBalle
*Assistant Examiner* — Leon W Rhodes, Jr.
(74) *Attorney, Agent, or Firm* — Venable LLP

(57) ABSTRACT

Provided is an image forming apparatus in which a movable member comes close to an opening to cover a part of the opening in the open state of an opening and closing member. In the course of change from the open state to the state in which an entering portion enters the inside of the housing, the movable member is pressed by the entering portion to move away from the opening and the opening and closing member moves toward the opening. In the closed state of the opening and closing member, the movable member is placed in a position further away from the opening than in the open state, and the opening and closing member is in the position in which the opening and closing member covers a part of the opening while forming a gap between the opening and closing member and the housing.

10 Claims, 14 Drawing Sheets

IMAGE FORMING APPARATUS

BACKGROUND OF THE INVENTION

Field of the Invention

The present invention relates to an image forming apparatus.

Description of the Related Art

An image forming apparatus conveys a sheet-shaped recording medium such as paper supplied from an outside to an image forming unit provided in the image forming apparatus and forms an image on the recording medium. The status of paper and the behavior of various mechanisms are influenced by an environment under which the apparatus is placed. In view of this, there has been known a technology in which information on an external environment such as temperature and humidity is acquired and fed back to control image formation (Japanese Patent Application Laid-open No. H11-130298). As means for acquiring information on an external environment, environment detection means for detecting temperature, humidity, or the like is provided in an apparatus shielded from an outside (Japanese Patent Application Laid-open No. 2010-169998). In order to increase the detection accuracy of environment detection means provided in an apparatus, there has been known a technology in which an opening for a louver, a fan, or the like is provided on the housing of an apparatus to cause outside air to flow through the inside of the housing (Japanese Patent Laid-open No. 2001-320527).

In order to detect environment information with environment detection means provided in an apparatus, it is necessary to provide an opening on the housing of the apparatus to cause outside air to flow through the inside of the housing and restrict the intrusion of foreign matter from an outside via the opening to protect the environment detection means. An apparatus will be specifically described using FIGS. 12 to 14. FIG. 12 is a perspective view of the apparatus. A housing 100 of the apparatus has a louver 101. FIG. 13 is a schematic cross-sectional view of the apparatus. FIG. 14 is a perspective view of an image forming unit accommodated in the housing 100. A shielding wall 102 is provided near the louver 101 inside the apparatus, and environment detection means 104 and a board 105 are provided inside the shielding wall 102. Thus, the environment detection means 104 and the board 105 are protected from the intrusion of foreign matter from an outside. Space 106 for ventilation is ensured between the shielding wall 102 and the louver 101, and space 107 for ventilation is ensured between the shielding wall 102 and the environment detection means 104. According to the configuration, the intrusion of foreign matter is prevented, while ventilation from an outside to the environment detection means 104 via the louver 101 is allowed.

SUMMARY OF THE INVENTION

When an opening for ventilation is provided on the housing of an apparatus as in the above related art, it is necessary to ensure the certain space between the opening and a shielding wall that protects environment detection means. In addition, it is necessary to increase the size of the shielding wall in order to ensure the protection of the environment detection means, and ensuring space for providing the shielding wall results in the upsize of the apparatus.

The present invention has been made in view of the above problems and has an object of providing a technology for reducing the upsize of an image forming apparatus while ensuring ventilation from an outside to an environment detection unit provided in the image forming apparatus.

It is provided with a view to achieving one aspect as describe above an image forming apparatus including:

a housing;

an opening and closing member provided on the housing;

an opening and closing detection unit that is provided inside the housing, includes a movable member that moves in conjunction with opening and closing of the opening and closing member, and detects an open state and a closed state of the opening and closing member based on a position of the movable member;

an environment detection unit that is provided in same space inside the housing as space in which the opening and closing detection unit is provided, and that detects environment information; and a control unit that controls an image forming operation according to a detection result of the environment detection unit, wherein the housing includes an opening that penetrates from an outside of the housing to the space which is inside the housing and in which the environment detection unit is provided, the opening and closing member includes an entering portion that enters the inside of the housing via the opening in a course of change from the open state to the closed state, the housing includes a gap between an edge of the opening and the entering portion in a state in which the entering portion enters the opening, the movable member comes close to the opening to cover at least a part of the opening in the open state of the opening and closing member, in a course of change from the open state to a state in which the entering portion enters the inside of the housing via the opening, the movable member is pressed by the entering portion to move in a direction away from the opening and the opening and closing member moves in a direction toward the opening, and in the closed state of the opening and closing member, the movable member is placed in a position further away from the opening than in the open state, and the opening and closing member is placed in a position in which the opening and closing member covers at least a part of the opening while forming a gap between the opening and closing member and the housing.

According to an embodiment of the present invention, it is possible to reduce the upsize of an image forming apparatus while ensuring ventilation from an outside to an environment detection unit provided in the image forming apparatus.

Further features of the present invention will become apparent from the following description of exemplary embodiments with reference to the attached drawings.

DESCRIPTION OF THE EMBODIMENTS

First Embodiment

A first embodiment of the present invention will be described in detail using the drawings. An image forming apparatus according to the first embodiment will be described using a monochrome laser beam printer. Note that the monochrome laser beam printer is an example and an image forming apparatus to which the present invention is applicable is not limited to the example. For example, a color laser beam printer may be used as such.

Figure 1:
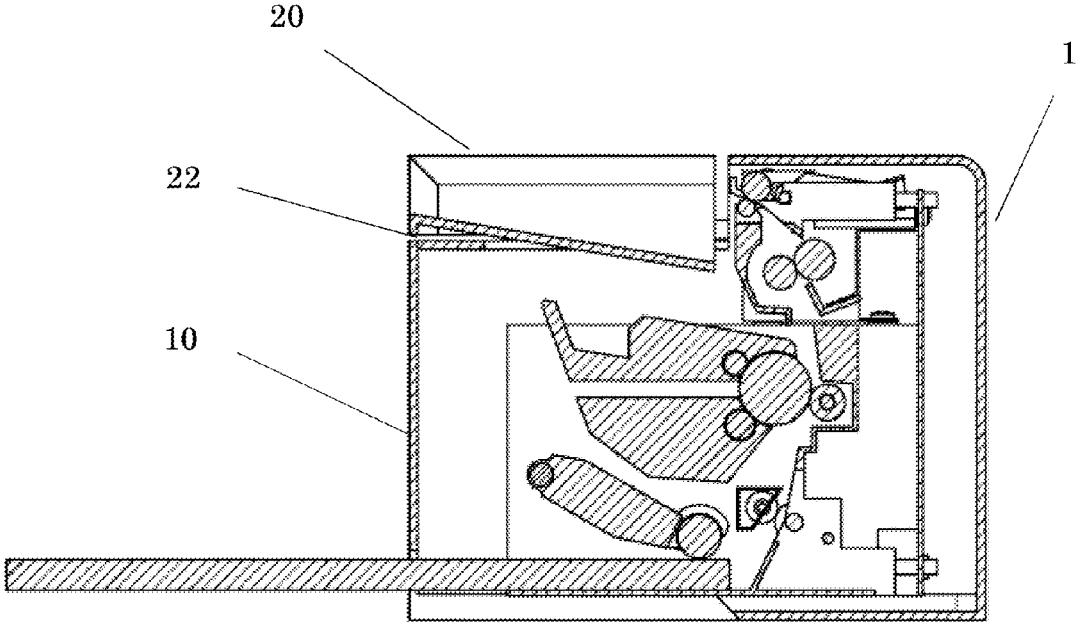
FIG. 1 is a schematic cross-sectional view of an image forming apparatus according to a first embodiment.
Figure 2:
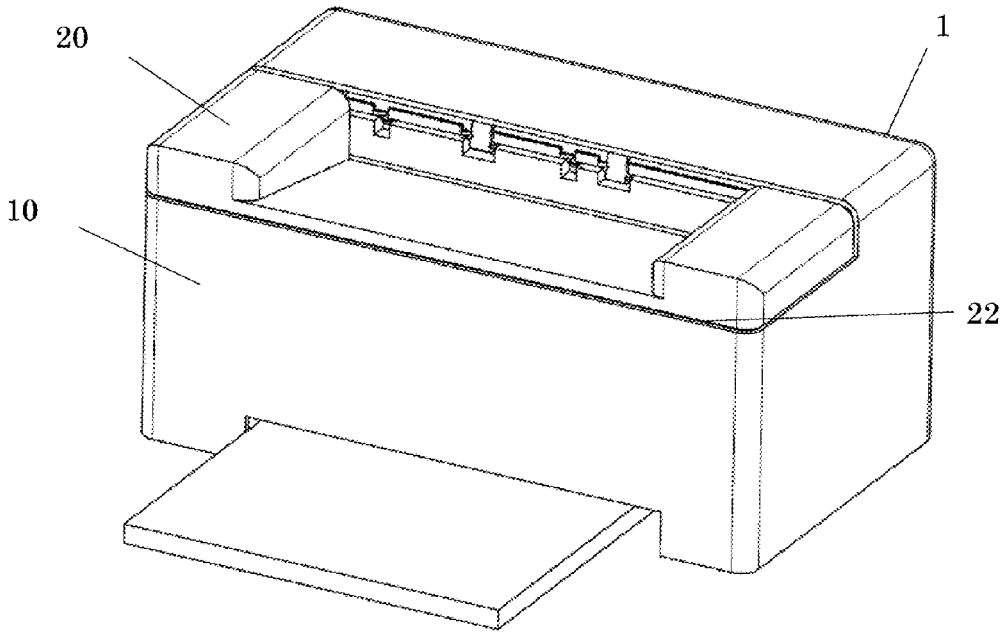
FIG. 2 is a perspective view illustrating a state in which the door of the image forming apparatus according to the first embodiment and a second embodiment is closed.
Figure 3:
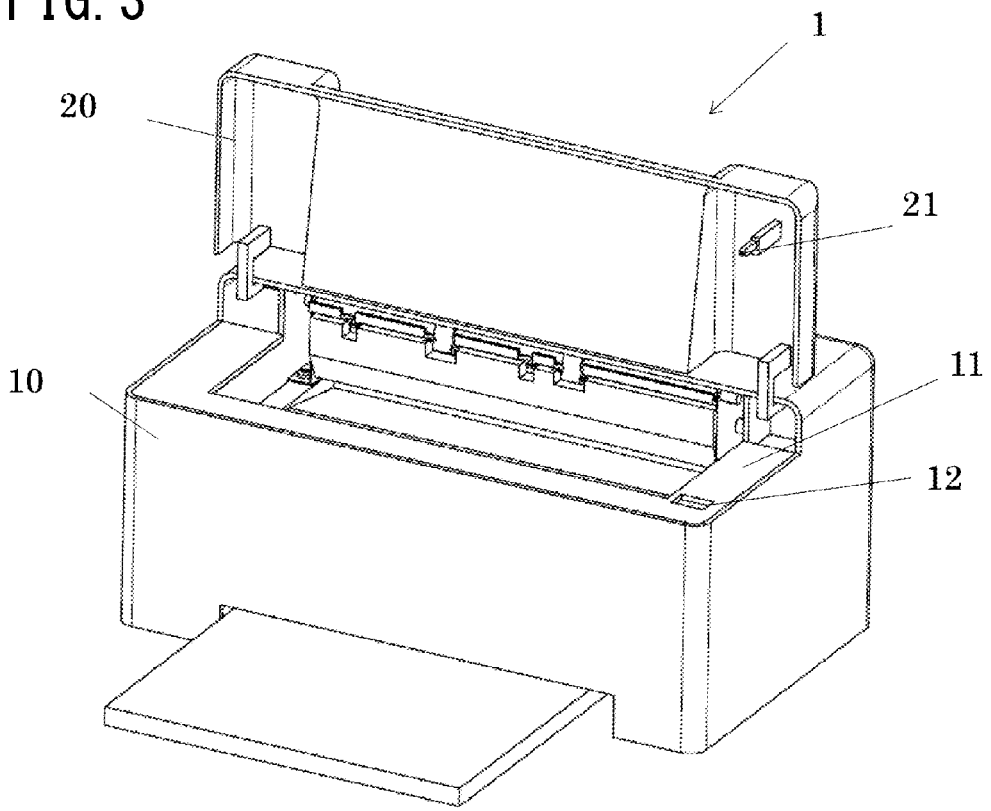
FIG. 3 is a perspective view illustrating a state in which the door of the image forming apparatus according to the first embodiment is open.

FIG. 1 is a schematic cross-sectional view illustrating the schematic configuration of an image forming apparatus 1 according to the first embodiment of the present invention. The image forming apparatus 1 includes a housing 10 that serves as an apparatus body and a door 20 that serves as an opening and closing member provided on the housing 10. The door 20 that serves as the opening and closing member is rotatably supported by the housing 10 that serves as the apparatus body. In the present embodiment, the door 20 that serves as the opening and closing member is rotatably supported by the housing 10 that serves as the apparatus body. However, the door 20 may be of a type capable of performing movement such as slide movement rather than performing rotational movement depending on its configuration. FIG. 1 illustrates the closed state of the door 20. In the closed state of the door 20, there is a gap 22 between the door 20 and the housing 10. Air is allowed to flow through the gap 22. FIG. 2 is a perspective view illustrating a state in which the door 20 of the image forming apparatus 1 is closed. FIG. 3 is a perspective view illustrating a state in which the door 20 of the image forming apparatus 1 is open. In the open state of the door 20, interior members are exposed so that a user replaces cartridges or clears a paper jam. In the closed state of the door 20, the cartridges and a conveyance mechanism are shielded from an outside, user's safety is ensured, and the exposure of the cartridges to unnecessary light is reduced. However, in the open state of the door 20 as well, it is necessary to protect gears or electric circuits constituting a driving unit from external contact, the drop of foreign matter, breakage caused by static electricity, or the like. Therefore, the housing 10 includes a cover 11 that isolates the members from the outside. The cover 11 is provided with an opening 12 that penetrates from the outside of the housing 10 to space which is inside the housing 10 and in which an environment sensor 50 and an opening and closing sensor 30 (that will be described later) are both provided. The door 20 has a protrusion 21 that serves as an entering portion configured to enter the inside of the housing 10 via the opening 12 in the course of change from the open state to the closed state.

The interior configuration of the image forming apparatus 1 and a configuration associated with the opening and closing operation of the door 20 will be described using FIGS. 4A to 4C to FIGS. 7A to 7C.

Figure 4A:
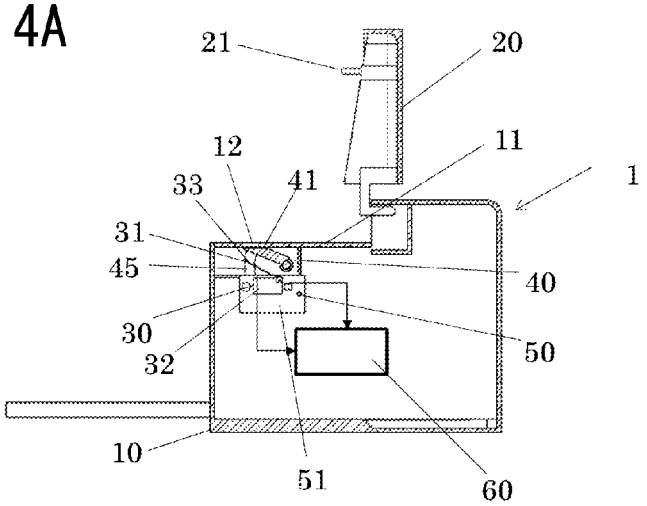
FIGS. 4A to 4C are perspective views each illustrating a state in which the door of the image forming apparatus according to the first embodiment is open.
Figure 4B:
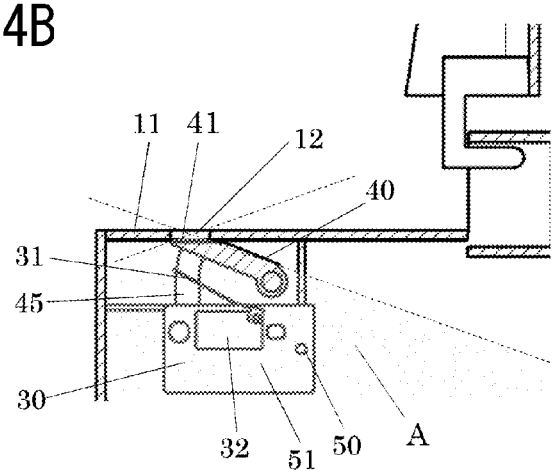
Figure 4C:
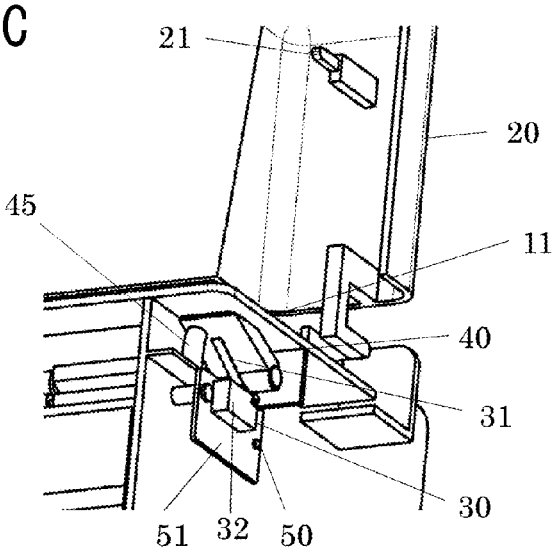

FIGS. 4A and 4B are views each illustrating a state (open state) in which the door 20 of the image forming apparatus 1 is open. FIG. 4A is a schematic cross-sectional view illustrating the state (open state) in which the door 20 of the image forming apparatus 1 is open. FIG. 4B is an enlarged view of the vicinity of the opening and closing sensor 30. FIG. 4C is a perspective view of the vicinity of the opening and closing sensor 30.

In space isolated from the outside by the cover 11 inside the housing 10, the opening and closing sensor 30 that serves as an opening and closing detection unit that detects the open state and closed state of the door 20 is provided. The opening and closing sensor 30 that serves as the opening and closing detection unit has a link 40 that serves as a movable member that moves in conjunction with the opening and closing of the door 20 that serves as the opening and closing member, and has a spring 45 that serves as a biasing member that biases the link 40 to the side of the opening 12. In addition, the opening and closing sensor 30 that serves as the opening and closing detection unit that detects the open state and closed state of the door 20 has an arm 31 configured to rotate in conjunction with the link 40, and a switch unit 32 that outputs a signal (an on-signal or an off-signal) corresponding to the open state and closed state of the door 20 according to the position of the arm 31. The link 40 covers at least a part of the opening but is pressed into the inside of the housing 10 by contact with the protrusion 21 that serves as the entering portion of the door 20 when the door 20 changes from the open state to the closed state. Therefore, the link 40 moves in a direction away from the opening when the door 20 changes from the open state to the closed state. Further, the opening and closing of the door 20 is detected based on the position of the arm 31 that moves in conjunction with the link 40. The arm 31 is configured to be rotatable with respect to the switch unit 32. When the door 20 changes from the open state to the closed state, the arm 31 also moves after receiving pressure from the link in conjunction with the movement of the link. An on-signal corresponding to the closed state is output when the distance of the arm 31 with respect to the switch unit 32 becomes smaller than a threshold, and an off-signal corresponding to the open state is output when the distance of the arm 31 with respect to the switch unit 32 becomes larger than the threshold. Note that the relationship between the signal (the on-signal or the off-signal) output from the switch unit 32 according to the open state and closed state of the door 20 and the distance of the arm 31 with respect to the switch unit 32 may be arbitrarily set.

In the same space inside the housing 10 as the space in which the opening and closing sensor 30 is provided, the environment sensor 50 that serves as an environment detection unit that detects temperature and/or humidity as environment information is provided. In the present embodiment, the environment sensor 50 that serves as the environment detection unit and the opening and closing sensor 30 that serves as the opening and closing detection unit are provided on a board 51 that serves as a common electric circuit board, and thus are provided in the same space. Note that the opening and closing sensor 30 that serves as the environment detection unit and the environment sensor 50 that serves as the opening and closing detection unit is only required to be arranged in the same space isolated from the outside by the cover 11. That is, the opening and closing sensor 30 and the environment sensor 50 may be provided on separate boards instead of being provided on the board 51 that serves as the common electric circuit board. In addition, the board 51 that serves as the electric circuit board may be omitted, provided that the specifications of the environment sensor 50 and the opening and closing sensor 30 allow. Moreover, the board 51 is an electric circuit board on which electric circuits, elements, and the like are provided, and the environment sensor 50 and the opening and closing sensor 30 are provided on the electric circuit board together with other circuits and elements. The board 51 is a member provided separately from the housing 10 and the internal frame of the image forming apparatus 1.

A control unit 60 controls the operation of the image forming apparatus 1 according to a detection result of the open state and closed state of the door 20 by the opening and closing sensor 30 that serves as the opening and closing detection unit and a detection result of the environment information by the environment sensor 50 that serves as the environment detection unit. For example, the control unit 60 performs control to prohibit an image forming operation when the open state of the door 20 is detected by the opening and closing sensor 30, and performs control to permit the image forming operation when the closed state of the door 20 is detected by the opening and closing sensor 30. That is, the control unit 60 controls the image forming apparatus so that the image forming operation is not performed when the open state of the door is detected, and that the image forming operation is performed when the closed state of the door is detected.

The cover 11 of the housing 10 protects the opening and closing sensor 30, the link 40, the spring 45, the environment sensor 50, the board 51, the control unit 60, or the like provided inside the housing 10 from contact from the outside, the drop of foreign matter, and breakage caused by static electricity.

In the open state of the door 20 illustrated in FIG. 4A, the protrusion 21 that serves as the entering portion of the door 20 is positioned away from the link 40, the link 40 is pressed upward in the direction of the opening 12 by the spring 45 that serves as the biasing member, and the arm 31 is released from the link 40. In the present embodiment, when pressed upward toward the opening, the link 40 comes close to the opening and is arranged in a position in which at least a part of the opening is covered. When the arm 31 is positioned away from the switch unit 32 by at least a certain distance, the opening and closing sensor 30 is turned off, whereby the open state of the door 20 is detected. Information on the detection of the open state of the door 20 is informed to the control unit 60.

From the open state of the door 20 to a state until the protrusion 21 of the door 20 starts entering the inside of the housing 10 via the opening 12, the same state as the state illustrated in FIG. 4A is made.

Figure 5:
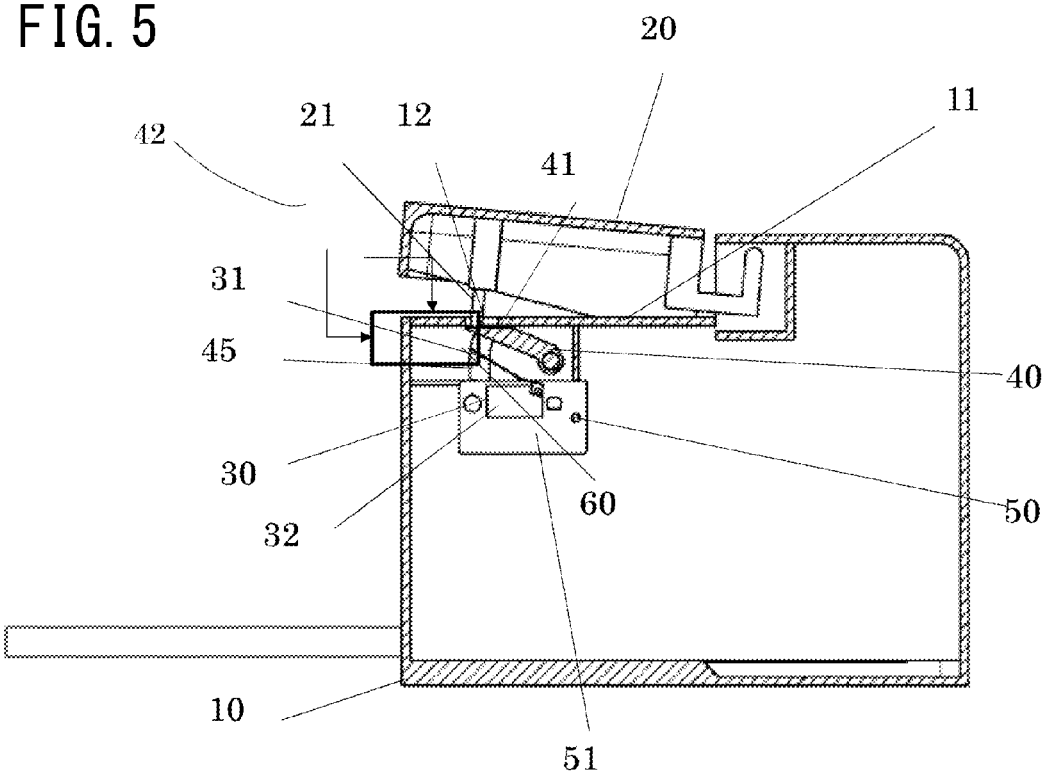
FIG. 5 is a schematic cross-sectional view illustrating a state in which the door of the image forming apparatus according to the first embodiment is placed in an intermediate position.
Figure 6:
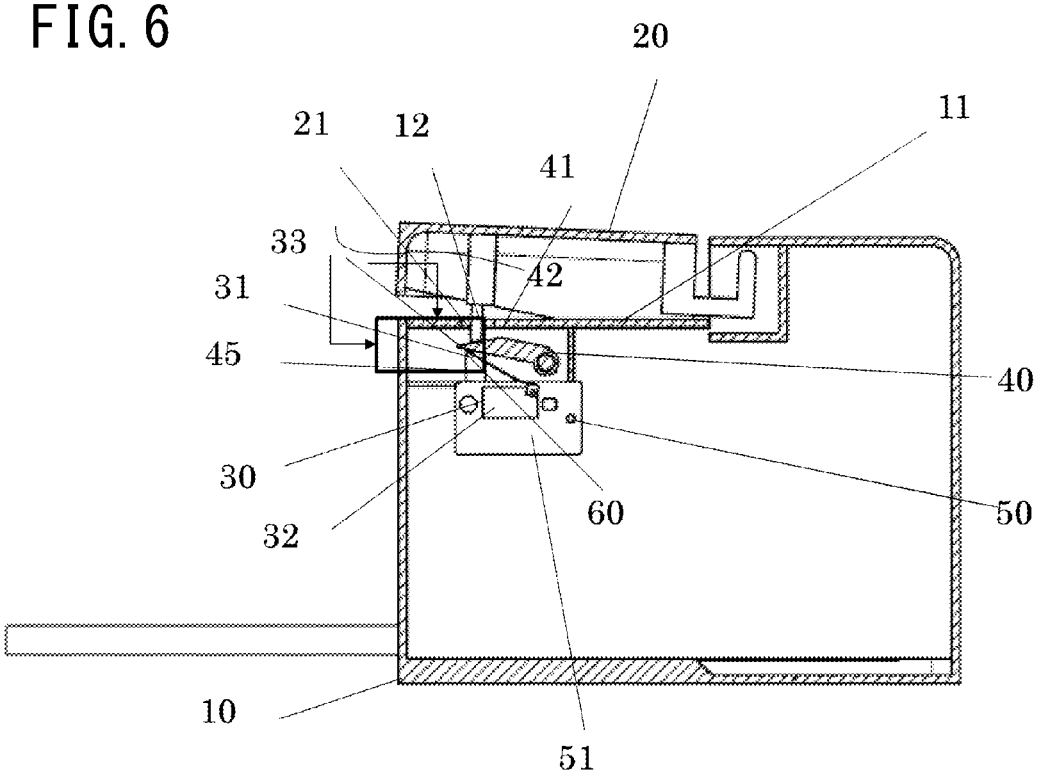
FIG. 6 is a schematic cross-sectional view illustrating a state in which the door of the image forming apparatus according to the first embodiment is placed in the intermediate position.

FIGS. 5 and 6 are schematic cross-sectional views each illustrating a state in which the door 20 of the image forming apparatus 1 is placed in the intermediate position between the closed state and the open state. In other words, the protrusion 21 that serves as the entering portion of the door 20 enters the opening in this state. FIG. 5 illustrates a state in which the protrusion 21 of the door 20 passes through the opening and contacts a surface 41 of the link 40. On this occasion, the states of the opening and closing sensor 30, the link 40, and the like are the same as those of the opening and closing sensor 30, the link 40, and the like in the open state of the door 20 illustrated in FIG. 4A. When the door 20 comes further close to the closed state, the link 40 is further pressed into the inside of the housing 10 by the protrusion 21 against the biasing force of the spring 45 that serves as the biasing member and moves in a direction away from the opening. Since there is a gap between the edge of the opening 12 and the protrusion 21 that serves as the entering portion in this state, air is allowed to flow into the housing.

FIG. 6 illustrates a state in which the door 20 comes further close to the closed state and a switch contact portion 42 of the link 40 contacts a surface 33 of the arm 31. When the protrusion 21 of the door 20 penetrates the opening 12 of the cover 11 and the link 40 is pressed into (the inside) of the housing 10 by at least a certain distance, the switch contact portion 42 of the link 40 contacts the surface 33 of the arm 31 and the arm 31 is pressed in a direction toward the switch unit 32. Since there is the gap between the edge of the opening 12 and the protrusion 21 that serves as the entering portion, air is allowed to flow into the housing.

Figure 7A:
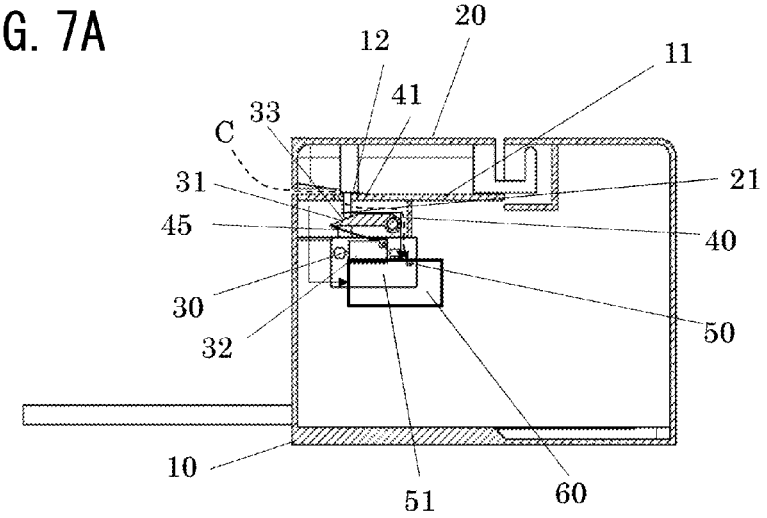
FIGS. 7A to 7C are views each illustrating a state in which the door of the image forming apparatus according to the first embodiment is closed.
Figure 7B:
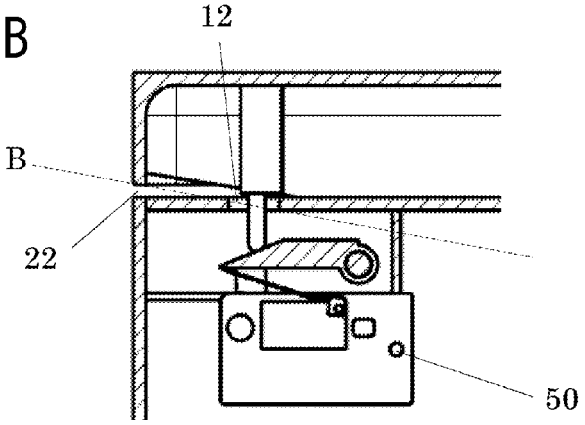
Figure 7C:
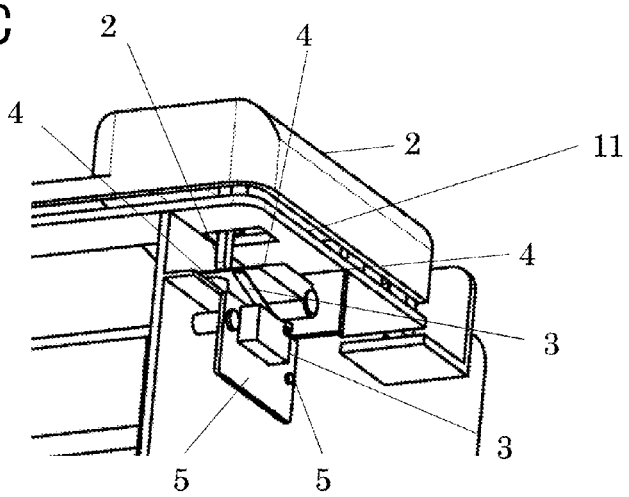

FIGS. 7A to 7C are views each illustrating a state (closed state) in which the door 20 of the image forming apparatus is closed. When the link 40 is further pressed into the inside of the housing 10, the arm 31 further comes close to the switch unit 32 and the opening and closing sensor 30 is turned on. When the opening and closing sensor 30 is turned on, the closed state of the door 20 is detected. Information on the detection of the closed state of the door 20 is informed to the control unit 60 that controls the various operations of the image forming apparatus. As illustrated in FIG. 7A, the door 20 is arranged to have a certain gap between the door 20 and the housing 10. Therefore, the flow of air may be generated as indicated by an arrow C. In addition, the protrusion of the door 20 is inserted in the opening of the housing 10 in the closed state of the door. In this state, there is a gap between the edge of the opening of the housing and the protrusion of the door 20. That is, since there is the gap between the edge of the opening of the housing and the protrusion of the door 20 in the closed state of the door, the housing is configured so that air is allowed to flow into the inside of the housing.

The effect of protecting the interior members from contact from the outside of the housing 10 in the open state, the closed state, and the intermediate state of the door 20 of the image forming apparatus will be described.

In the open state of the door 20 illustrated in FIG. 4A, the link 40 is biased to the side of the cover 11 by the spring 45. The surface area of the surface 41 of the link 40 is larger than the opening area of the opening 12. In a state in which the link 40 is pressed upward to the side of the cover 11 by the spring 45 and is not pressed into the inside of the housing 10 by the protrusion 21, the surface 41 of the link 40 comes close to the opening 12 of the cover 11 from the inside of the housing 10 as illustrated in FIG. 4B. Thus, the entire opening 12 is covered by the surface 41 of the link 40. A region denoted by symbol A is a region not visually recognizable from the outside. In the region A, members including the environment sensor 50 or the like desirably protected from the outside are provided. As illustrated in FIG. 4C, since the opening 12 is covered by the link 40 provided for the operation of the opening and closing sensor 30 that detects the opening and closing of the door 20 in the open state of the door 20, the interior members of the housing 10 are protected from contact from the outside of the housing 10 via the opening 12. In the embodiment, the entire opening is configured to be covered by the link that serves as the movable member, but the opening may be configured to be partially covered. In the configuration in which the opening is partially covered from the viewpoint of the safety of the sensors, it is preferable that the sensors be not visually recognizable from an uncovered portion.

In the intermediate state between the open state and the closed state of the door 20 illustrated in FIG. 5, the protrusion 21 contacts the surface 41 of the link 40 but does not press the link downward. Therefore, like the state illustrated in FIG. 4A, the opening 12 is closed by the link 40, and the interior members of the housing 10 are protected from contact from the outside of the housing 10 via the opening 12.

In a state in which the door 20 comes further close to the closed state illustrated in FIG. 6, the link 40 is pressed into the inside of the housing 10 and separated from the opening 12, and the door 20 comes close to the opening 12 from the outside of the housing 10. On this occasion, the door 20 and the link 40 are configured to keep a distance from the opening 12 and cover the entire opening 12 to such an extent that the environment sensor 50 or the like is not visually recognizable from the outside. That is, the interior members of the housing 10 are protected from contact from the outside of the housing 10 via the opening 12 by any or both of the door 20 and the link 40. From a state in which the protrusion 21 of the door 20 starts entering the inside of the housing 10 via the opening 12 to the closed state of the door 20, the same as the state illustrated in FIG. 6 is made.

In the closed state of the door 20 illustrated in FIG. 7A, the link 40 is pressed downward by the protrusion 21 as illustrated in FIGS. 7B and 7C. The protrusion 21 is configured to have a gap between the protrusion 21 and the edge of the opening 12 in a state of entering the opening 12. Accordingly, the opening 12 is open in the closed state of the door 20 but is entirely covered by the door 20 with the gap 22 formed therebetween. As illustrated by a straight line B in FIG. 7B, the interior environment sensor 50 or the like is not visually recognizable from the outside of the housing 10 via the gap 22 and the opening 12 in the closed state of the door 20. Therefore, the environment sensor 50 or the like inside the housing 10 may be protected from contact from the outside of the housing 10. In the present embodiment thus exemplified, the door 20 is configured to be placed in a position in which the door 20 covers the entire opening 12 in the closed state. However, the door 20 may be configured to be placed in a position in which the door 20 covers at least a part of the opening 12 in the closed state. In this case, the door 20 preferably covers the opening 12 to such an extent that the sensors are not visually recognizable in consideration of the safety of the sensors.

The ventilation between the outside of the housing 10 and the environment sensor 50 inside the housing 10 in the open state, the closed state, and the intermediate state the door 20 of the image forming apparatus will be described.

In the open state of the door 20 illustrated in FIG. 4A, the link 40 is biased to the side of the cover 11 by the spring 45 and comes close to the opening 12 from the inside of the housing 10. The area of the surface 41 of the link 40 is substantially larger than the opening area of the opening 12 provided on the cover 11, and the link 40 covers the entire opening 12 so as to have a prescribed gap (for example, several millimeters) with the cover 11. Accordingly, the link 40 covers the entire opening 12 without sealing the same. Therefore, although the flow of air decreases compared with a case in which the opening 12 is open, ventilation from the outside of the housing 10 to the environment sensor 50 inside the housing 10 is provided via the opening 12.

In the intermediate state between the open state and the closed state of the door 20 illustrated in FIGS. 5 and 6, the surface 41 of the link 40 is separated from the opening 12, and the opening area of the opening 12 is larger than the cross-sectional area of the protrusion 21. Therefore, even in a state in which the protrusion 21 penetrates the opening 12, there is a gap between the edge of the opening 12 and the protrusion 21. Accordingly, the opening 12 becomes moderately open. In addition, the door 20 is separated from the cover 11, and the flow of air from the outside of the housing 10 to the opening 12 is allowed. Accordingly, ventilation from the outside of the housing 10 to the environment sensor 50 inside the housing 10 is provided.

In the closed state of the door 20 illustrated in FIG. 7A, the opening 12 of the cover 11 becomes open when the link 40 is pressed downward by the protrusion 21 as illustrated in FIGS. 7B and 7C. In this state, there is a gap between the lateral surface of the protrusion 21 and the edge of the opening 12. In addition, there is the gap 22 between the door 20 and the housing 10. Therefore, ventilation from the outside of the housing 10 to the environment sensor 50 inside the housing 10 is provided via the gap 22 and the opening 12 in an open state as indicated by symbol C.

The environment sensor 50 detects environment information around the sensors such as temperature and humidity. A detection result of the environment sensor 50 is sent to the control unit 60 that controls the image forming operation of the image forming apparatus, and the control unit 60 controls the image forming operation suitable for environmental conditions under which the apparatus is placed based on the environment information. When influence by constituents (for example, the heat generation of a power supply or a motor) inside the housing 10 with respect to the detection result of the environment sensor 50 is negligible, the control unit 60 uses a detection value of the environment sensor 50 as it is for the control of the image forming apparatus. When the influence by the constituents inside the housing 10 is not negligible, the control unit 60 corrects the detection value of the environment sensor 50 in consideration of the influence by the constituents inside the housing 10 to be used for the control of the image forming apparatus. For example, when temperature detected by the environment sensor 50 is at least a threshold, the control unit 60 performs control to restrict a continuous print number to reduce the overheat of the apparatus and set a standby time for radiation and cooling for a certain time for each printing of a prescribed number of sheets. In addition, when temperature detected by the environment sensor 50 is lower than a threshold, the control unit 60 performs control to increase a heating amount in a fixation device for reliable toner fixation.

In the image forming apparatus according to the first embodiment, the opening 12 provided for the opening and closing sensor 30 that detects the opening and closing of the door 20 is used to ensure ventilation to the environment sensor 50. Therefore, it is not necessary to separately provide a louver or the like for ensuring ventilation to the environment sensor 50. In addition, the link 40 for switching the switch unit 32 of the opening and closing sensor 30 in conjunction with the opening and closing of the door 20 is used to serve as means for restricting contact from the outside with respect to the environment sensor 50. Therefore, it is not necessary to separately provide a shielding wall that protects the environment sensor 50 from contact from the outside. In addition, the environment sensor 50 is provided on the board 51 common to the opening and closing sensor 30. Therefore, it is not necessary to separately provide space for providing the environment sensor 50 inside the housing. Moreover, the gap 22 between the door 20 and the housing 10 in the closed state of the door 20 is formed, and the gap between the edge of the opening 12 and the protrusion 21 is formed in a state in which the protrusion 21 penetrates the opening 12. Therefore, ventilation from the outside of the housing 10 to the environment sensor 50 inside the housing 10 is ensured in the closed state of the door 20. Further, the link 40 covers the entire opening 12 so as to have a certain gap between the link 40 and the opening in the open state of the door 20. Therefore, ventilation from the outside of the housing 10 to the environment sensor 50 inside the housing 10 is ensured in the open state of the door 20. In the manner described above, it is possible to restrict contact from the outside while ensuring ventilation from the outside to the environment sensor 50 provided inside the image forming apparatus 1, reduce the upsize of the image forming apparatus 1, and increase the accuracy of environment information detected by the environment sensor 50.

Note that in the first embodiment thus exemplified, the area of the surface 41 of the link 40 is configured to be larger than the opening area of the opening 12, and the link 40 is configured to cover the entire opening 12 so as to have a certain gap between the link 40 and the cover 11 in a state of being not pressed by the protrusion 21. However, the configuration of the present invention is not limited to this configuration. For example, the link 40 or the like may be configured so that the opening 12 is sealed in a state in which the link 40 is not pressed by the protrusion 21. In this case, until the protrusion 21 contacts the link 40 from the open state of the door 20, ventilation from the outside of the housing 10 to the environment sensor 50 inside the housing 10 is not provided. However, from a state in which the link 40 is pressed into the inside of the housing 10 by the protrusion 21 to the closed state of the door 20, ventilation from the outside to the environment sensor 50 is provided since the link 40 is separated from the opening 12. Accordingly, the accuracy of a detection value by the environment sensor 50 may be ensured to a certain extent. Further, in a state in which the link 40 is not pressed by the protrusion 21, the link 40 may be configured to cover a part of the opening 12 to such an extent that the environment sensor 50 is not visually recognizable from the outside of the housing 10. In this case, the environment sensor 50, the opening and closing sensor 30, the driving gears, the electric circuits, or the like not illustrated inside the housing 10 are only required to be not influenced by contact, the drop of foreign matter, the discharge of static electricity, or the like from the outside of the housing 10 via a portion of the opening 12 not covered by the link 40. For example, a member to be protected is only required to be visually unrecognizable from the outside of the housing 10 via a portion of the opening 12 not covered by the link 40. Thus, it is possible to ensure ventilation from the outside of the housing 10 to the environment sensor 50, while protecting the environment sensor 50 inside the housing 10 from contact from the outside of the housing 10.

Second Embodiment

Figure 8:
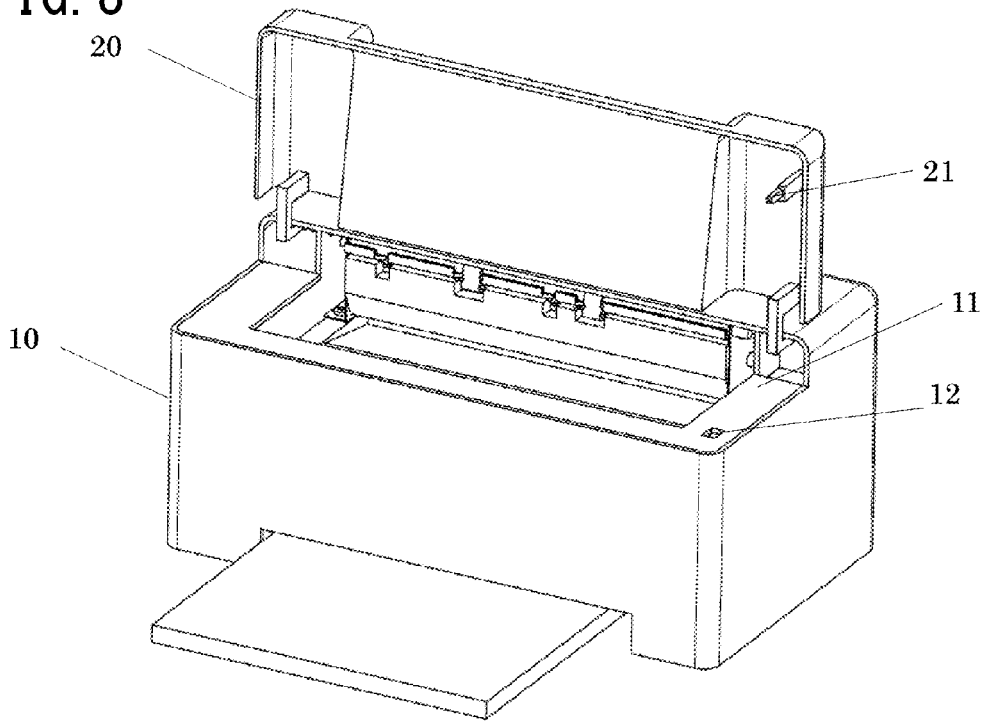
FIG. 8 is a perspective view illustrating a state in which the door of the image forming apparatus according to a second embodiment is open.

An example in which the present invention is applied to a configuration in which an opening and closing sensor for a door that serves as an opening and closing member does not have a link will be described as a second embodiment of the present invention. Hereinafter, the descriptions of respects common to the image forming apparatus according to the first embodiment will be omitted, and the difference between the first embodiment and the second embodiment will be mainly described. A state (closed state) in which the door of an image forming apparatus according to the second embodiment is closed is the same as that of the image forming apparatus according to the first embodiment and is illustrated in FIG. 2. Like the first embodiment, there is a gap 22 between a housing 10 and a door 20 in a state in which the door 20 that serves as an opening and closing member is closed. A perspective view illustrating a state (open state) in which the door of the image forming apparatus according to the second embodiment is open is illustrated in FIG. 8.

The difference between the first embodiment and the second embodiment is that an arm 31 of an opening and closing sensor 30 serves as a movable member in the second embodiment although the link 40 serves as the movable member in the first embodiment. That is, the arm 31 that serves as the movable member of the opening and closing sensor 30 covers at least a part of an opening 12 of a cover 11 in a state in which the door 20 is open. On the other hand, the arm 31 is pressed into the inside of the housing 10 by a protrusion 21 and moves in a direction away from the opening 12 in a state in which the door 20 is closed. Accordingly, the image forming apparatus according to the second embodiment does not have the link 40 and the spring 45 that serves as the biasing member for biasing the link 40 to the side of the cover 11 in the first embodiment. The arm 31 is configured to rotate with respect to a switch unit 32. The arm 31 has elasticity and rotates from a position in which the arm 31 covers the opening 12 to the inside of the housing 10 when pressed into the inside of the housing 10 by the protrusion 21. When released from the operation of a force with which the arm 31 is pressed into the inside of the housing 10, the arm 31 is configured to return to a position in which the opening 12 is sealed due to its elasticity. The point that a signal corresponding to the open state and closed state of the door 20 output from the opening and closing sensor 30 is turned on or off according to the position of the arm 31 with respect to the switch unit 32 is the same as that of the first embodiment. The size of the opening 12 is substantially larger than that of the protrusion 21 of the door 20. There is a gap between the opening 12 and the protrusion 21 even in a state in which the protrusion 21 penetrates the opening 12. The ventilation between an inside and an outside is provided via the gap. In addition, the size of the opening 12 is configured so that a surface 33 of the arm 31 covers the entire opening 12 in a state in which the arm 31 returns to the cover 11 due to its elasticity. Note that on this occasion, the point that the surface 33 of the arm 31 may be configured to seal the opening 12 or the point that the surface 33 of the arm 31 may be configured to cover a part of the opening 12 to such an extent that an environment sensor 50 is visually unrecognizable from the outside is the same as that of the link 40 according to the first embodiment. From the viewpoint of the safety of the sensors, it is preferable that the sensors be visually unrecognizable from an uncovered portion even in the configuration in which the opening is partially covered.

The interior configuration of an image forming apparatus 1 and a configuration associated with the opening and closing operation of the door 20 will be described using FIGS. 9A and 9B to FIGS. 11A and 11B.

Figure 9A:
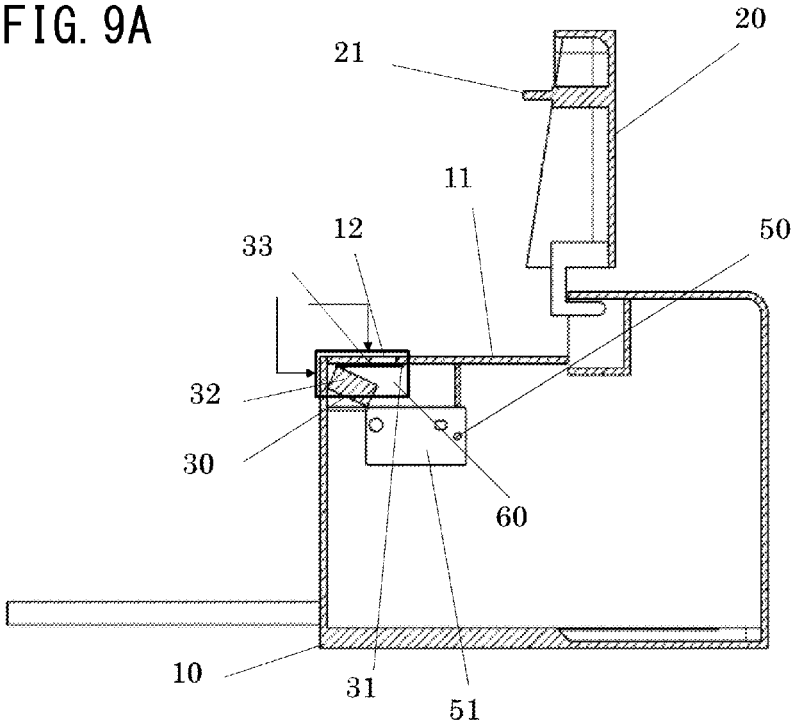
FIGS. 9A and 9B are views each illustrating a state in which the door of the image forming apparatus according to the second embodiment is open.
Figure 9B:
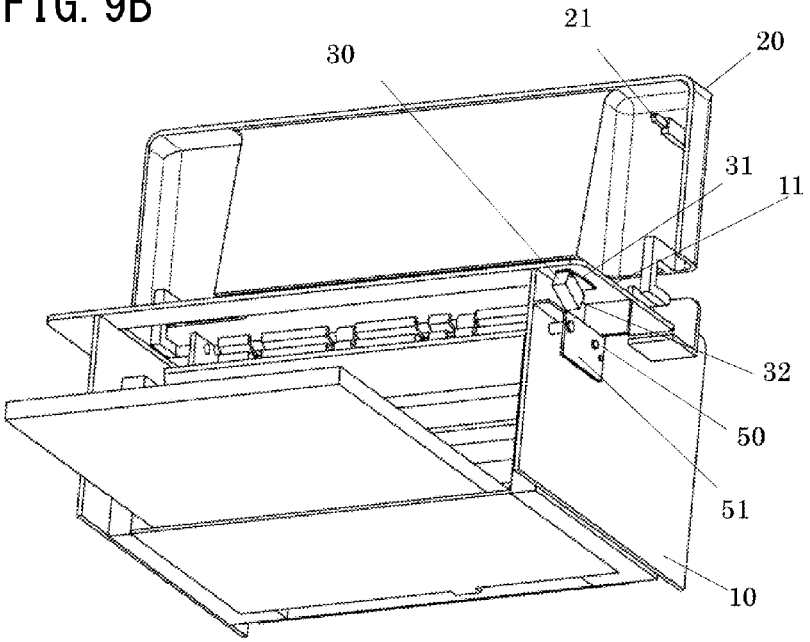
Figure 10A:
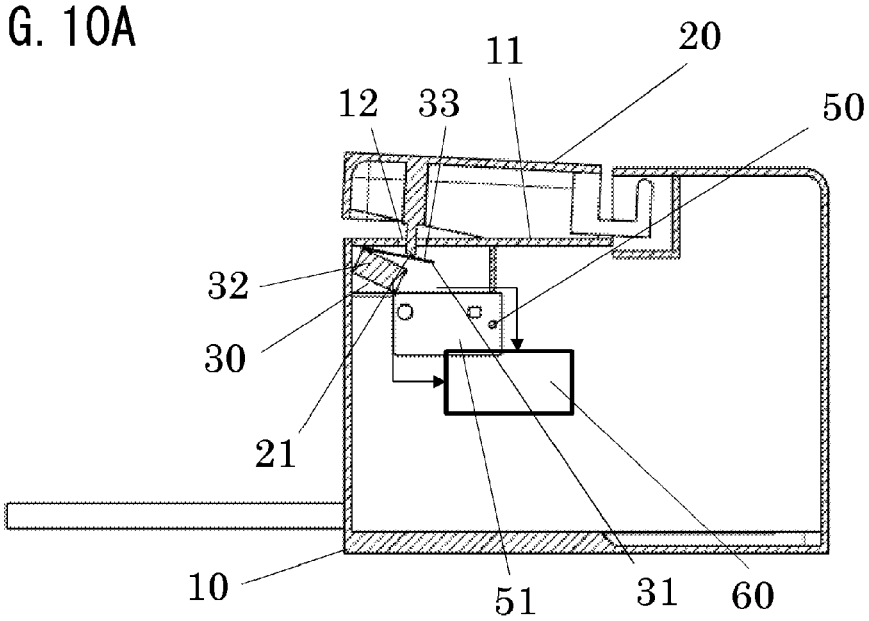
FIGS. 10A and 10B are views each illustrating a state in which the door of the image forming apparatus according to the second embodiment is placed in the intermediate position.
Figure 10B:
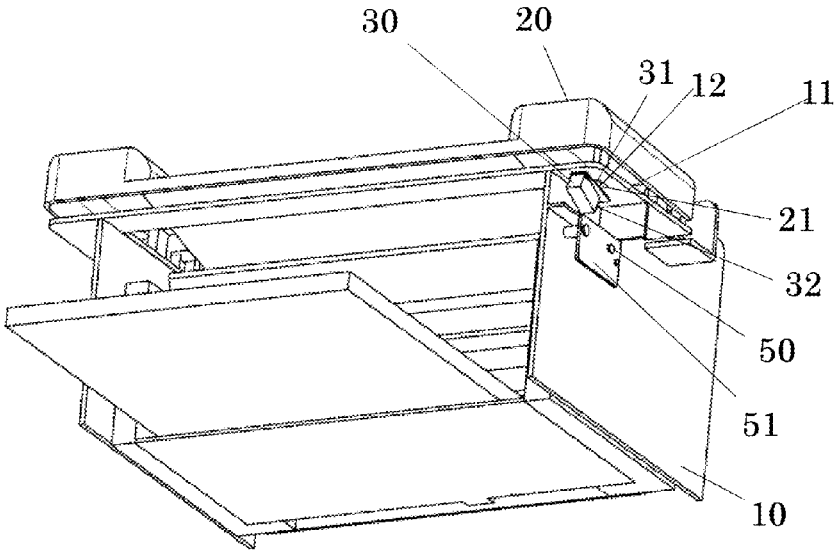
Figure 11A:
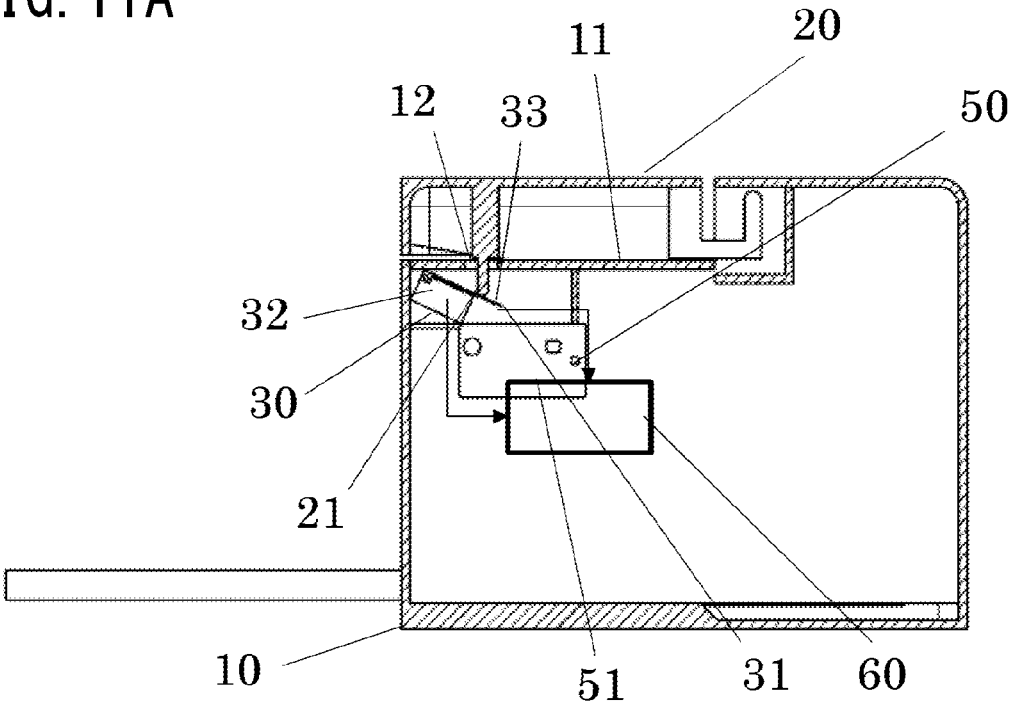
FIGS. 11A and 11B are views each illustrating a state in which the door of the image forming apparatus according to the second embodiment is closed.
Figure 11B:
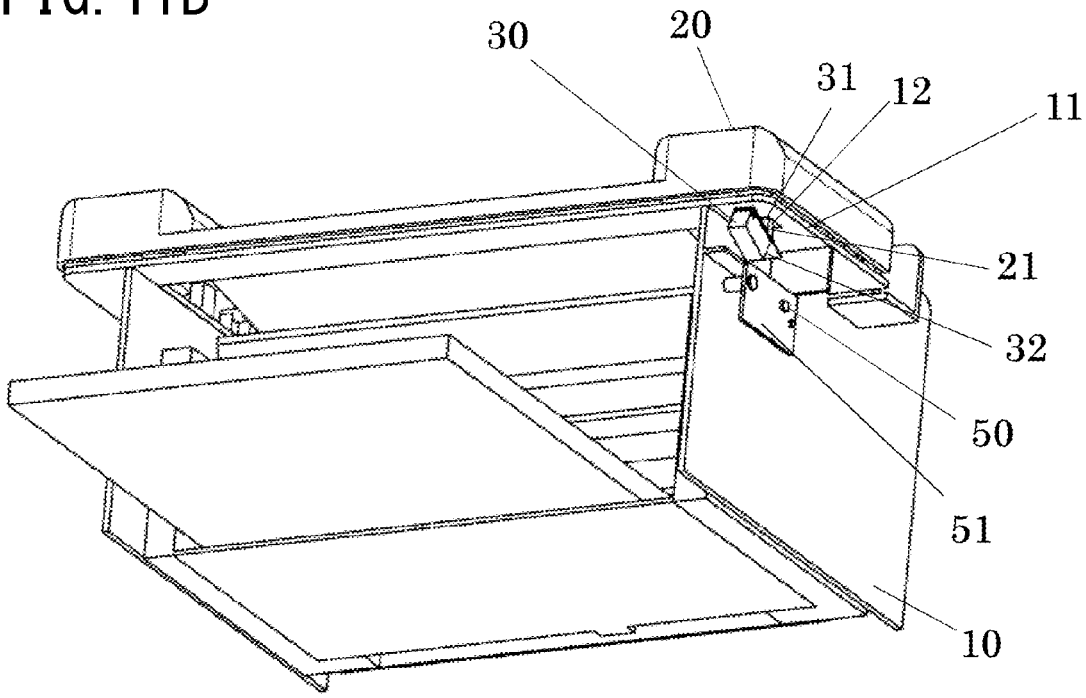
Figure 12:
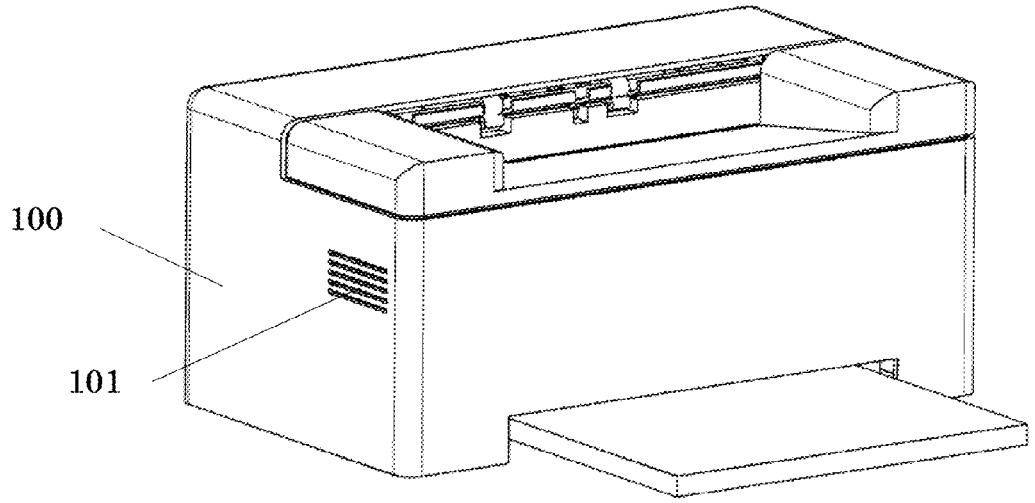
FIG. 12 is a perspective view of an image forming apparatus according to the related art.
Figure 13:
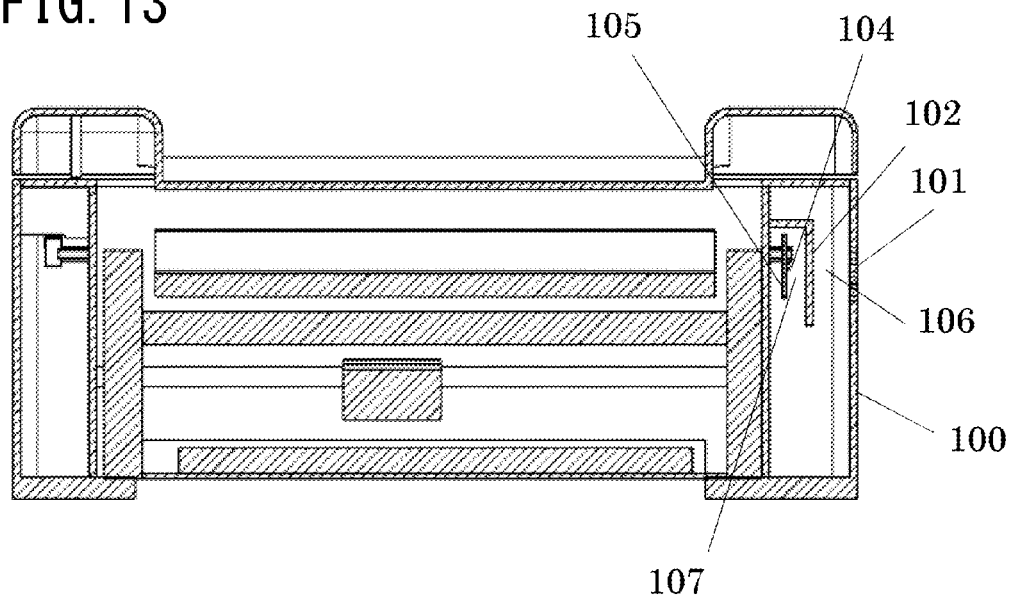
FIG. 13 is a schematic cross-sectional view of the image forming apparatus according to the related art.
Figure 14:
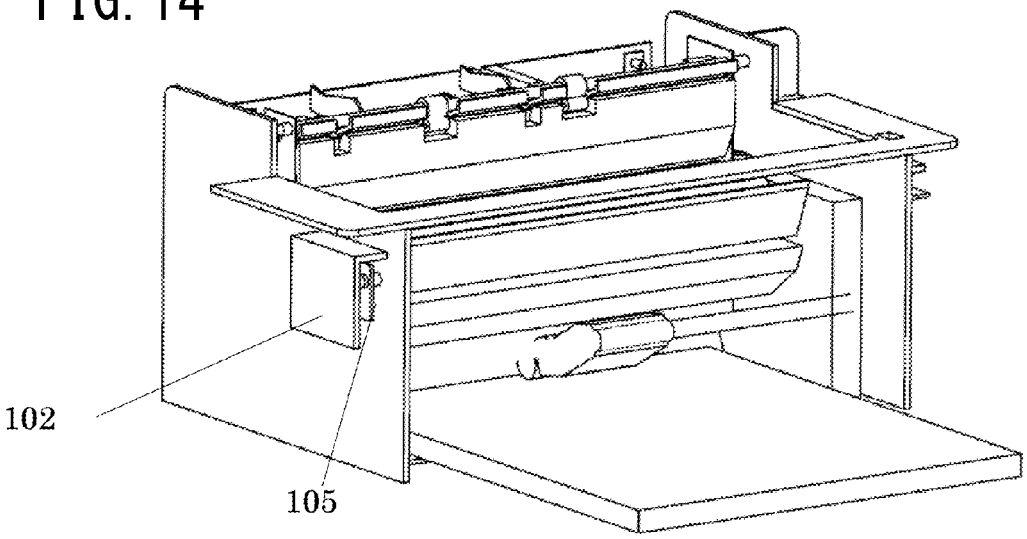
FIG. 14 is a perspective view of an image forming unit inside the image forming apparatus according to the related art.

FIGS. 9A and 9B are views illustrating a state (open state) in which the door 20 of the image forming apparatus 1 is open. FIGS. 10A and 10B are schematic cross-sectional views illustrating a state in which the door 20 of the image forming apparatus 1 is placed in an intermediate position between a closed state and an open state. In this state, the door 20 comes further close to the closed state from a state in which the door 20 starts closing, and the protrusion 21 contacts the surface 33 of the arm 31. FIGS. 11A and 11B are views illustrating a state in which the door 20 of the image forming apparatus 1 is closed.

In the open state of the door 20 illustrated in FIG. 9A, the protrusion 21 is separated from the surface 33 of the arm 31, and the arm 31 is released from the function of a force with which the arm 31 is pressed into the inside of the housing 10 by the protrusion 21. When the arm 31 is separated from the switch unit 32 by at least a certain distance, the opening and closing sensor 30 is turned off, whereby the open state of the door 20 is detected.

In the intermediate state between the open state and the closed state of the door 20 illustrated in FIG. 10A, the protrusion 21 of the door 20 contacts the surface 33 of the arm 31 and is then further pressed into (the inside) of the housing 10 while penetrating the opening 12. Thus, the arm 31 is pressed into the inside of the housing 10. When the arm 31 comes close to the switch unit 32 by at least a certain distance, the opening and closing sensor 30 is turned on, whereby the closed state of the door 20 is detected.

The effect of protecting the inside of the housing 10 from contact from the outside of the housing 10 in the open state, the closed state, and the intermediate state of the door 20 of the image forming apparatus will be described.

In the open state of the door 20 illustrated in FIG. 9A, the arm 31 returns to a position closest to the cover 11 by its elasticity. The surface area of the surface 33 of the arm 31 is larger than the opening area of the opening 12. In a state in which the arm 31 returns to the position closest to the cover 11 and is not pressed into the inside of the housing 10 by the protrusion 21, the surface 33 of the arm 31 comes close to the opening 12 of the cover 11 from the inside of the housing 10 as illustrated in FIG. 9B. Thus, the entire opening 12 is covered by the surface 33 of the arm 31, and the environment sensor 50 or the like inside the housing 10 is protected from contact from the outside of the housing 10 via the opening 12. In the present embodiment, the opening is configured to be entirely covered by the arm. However, the opening may be configured to be partially covered. From the viewpoint of the safety of the sensors, it is preferable that the sensors be visually unrecognizable from an uncovered portion even in the configuration in which the opening is partially covered.

The intermediate state between the open state and the closed state of the door 20 illustrated in FIG. 10A is a state in which the door 20 further moves in a closed direction from a state in which the door 20 starts closing. In the state in which the door 20 has starts closing, the protrusion 21 contacts the surface 33 of the arm 31 but does not press the arm 31 downward as described in the first embodiment with reference to FIG. 5. In FIG. 10A, the door 20 further moves in the closed direction from the state in which the protrusion 21 contacts the surface 33 but does not press the arm 31 downward. In this state, the protrusion 21 penetrates the opening 12 and is further pressed into the inside of the housing 10, the arm 31 is separated from the opening 12, and the door 20 comes close to the opening 12 from the outside of the housing 10. On this occasion, the opening 12 of the cover 11 is not covered by the surface 33 of the arm 31. In addition, the door 20 and the arm 31 are configured to keep a distance from the opening 12 and cover the entire opening 12 to such an extent that the environment sensor 50 or the like is visually unrecognizable from the outside. That is, the members inside the housing 10 are protected from contact from the outside of the housing 10 via the opening 12 by any or both of the door 20 and the arm 31. In the present embodiment, the opening is configured to be entirely covered by the door. However, the opening may be configured to be at least partially covered. In this case, the door preferably covers the opening to such an extent that the sensors are visually unrecognizable in consideration of the safety of the sensors.

In the closed state of the door 20 illustrated in FIG. 11A, the arm 31 is pressed downward by the protrusion 21. The protrusion 21 is configured so as to have a gap between the protrusion 21 and the edge of the opening 12 in a state of entering the opening 12. Accordingly, the opening 12 is open in the closed state of the door 20 but entirely covered by the door 20 with the gap 22 formed therebetween. Therefore, contact from the outside of the housing 10 with respect to the environment sensor 50 or the like inside the housing 10 is restricted.

The ventilation between the outside of the housing 10 and the environment sensor 50 in the open state, the closed state, and the intermediate state of the door 20 of the image forming apparatus will be described.

In the open state of the door 20 illustrated in FIG. 9A, the surface 33 of the arm 31 comes close to the opening 12 of the cover 11 from the inside of the housing 10 as illustrated in FIG. 9B. The area of the surface 33 of the arm 31 is substantially larger than the opening area of the opening 12 provided on the cover 11, and the arm 31 covers the entire opening 12 so as to have a prescribed gap (for example, several millimeters) with the cover 11. Accordingly, the surface 33 of the arm 31 covers the entire opening 12 without sealing the same. Therefore, although the flow of air decreases compared with a case in which the opening 12 is open, ventilation from the outside of the housing 10 to the environment sensor 50 is provided via the opening 12.

In the intermediate state between the open state and the closed state of the door 20 illustrated in FIGS. 10A and 10B, the surface 33 of the arm 31 is separated from the opening 12, and the opening area of the opening 12 is larger than the cross-sectional area of the protrusion 21. Therefore, even in a state in which the protrusion 21 penetrates the opening 12, there is a gap between the opening 12 and the protrusion 21. Accordingly, the opening 12 becomes moderately open. In addition, the door 20 is separated from the cover 11, and the flow of air from the outside of the housing 10 to the opening 12 is allowed. Accordingly, ventilation from the outside of the housing 10 to the environment sensor 50 is provided.

In the closed state of the door 20 illustrated in FIG. 11A, the opening 12 of the cover 11 becomes open when the arm 31 is pressed downward by the protrusion 21. In addition, there is the gap 22 between the door 20 and the housing 10. Therefore, ventilation from the outside of the housing 10 to the environment sensor 50 is provided via the gap 22 and the opening 12 in an open state.

According to the image forming apparatus of the second embodiment, ventilation to the environment sensor 50 is ensured by the opening 12 provided for the opening and closing sensor 30 like the image forming apparatus of the first embodiment. In addition, contact from the outside with respect to the environment sensor 50 is restricted by the arm 31 of the opening and closing sensor 30. Therefore, it is not necessary to separately provide a louver or the like for ensuring ventilation to the environment sensor 50. In addition, it is not necessary to separately provide a shielding wall that protects the environment sensor 50 from contact from the outside. Moreover, ventilation from the outside to the environment sensor 50 is ensured in both the closed state and the open state of the door 20. It is possible to restrict contact from the outside while ensuring ventilation from the outside to the environment sensor 50 provided inside the image forming apparatus 1, reduce the upsize of the image forming apparatus 1, and increase the accuracy of environment information detected by the environment sensor 50. Further, since the arm 31 that serves as the constituent of the opening and closing sensor 30 is used as a member for covering the opening 12, the number of components may be reduced compared with the case of the first embodiment in which the link 40 is used, which is beneficial for saving space.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-009637, filed on Jan. 24, 2018, which is hereby incorporated by reference herein in its entirety.

What is claimed is:

1. An image forming apparatus comprising:

a housing;

an opening and closing member provided on the housing;

an opening and closing detection unit that is provided inside the housing, includes a movable member that moves in conjunction with opening and closing of the opening and closing member, and detects an open state and a closed state of the opening and closing member based on a position of the movable member;

an environment detection unit that is provided in same space inside the housing as space in which the opening and closing detection unit is provided, and that detects environment information; and a control unit that controls an image forming operation according to a detection result of the environment detection unit, wherein the housing includes an opening that penetrates from an outside of the housing to the space which is inside the housing and in which the environment detection unit is provided, the opening and closing member includes an entering portion that enters the inside of the housing via the opening in a course of change from the open state to the closed state, the housing includes a gap between an edge of the opening and the entering portion in a state in which the entering portion enters the opening, the movable member comes close to the opening to cover at least a part of the opening in the open state of the opening and closing member, in a course of change from the open state to a state in which the entering portion enters the inside of the housing via the opening, the movable member is pressed by the entering portion to move in a direction away from the opening and the opening and closing member moves in a direction toward the opening, and in the closed state of the opening and closing member, the movable member is placed in a position further away from the opening than in the open state, and the opening and closing member is placed in a position in which the opening and closing member covers at least a part of the opening while forming a gap between the opening and closing member and the housing.

2. The image forming apparatus according to claim 1, wherein the movable member comes close to the opening to seal the opening in the open state of the opening and closing member.

3. The image forming apparatus according to claim 1, wherein the movable member comes close to the opening to cover the entire opening without sealing the opening in the open state of the opening and closing member.

4. The image forming apparatus according to claim 1, wherein the movable member comes close to the opening to cover a part of the opening to such an extent that the environment detection unit is visually unrecognizable from the outside in the open state of the opening and closing member.

5. The image forming apparatus according to claim 1, wherein the movable member includes a link that is pressed into the inside of the housing by contact with the entering portion, and a biasing member that biases the link in a direction of the opening, and the opening and closing detection unit includes an arm that is pressed by the link, and a switch unit that outputs a signal corresponding to the open state and the closed state of the opening and closing member according to a position of the arm.

6. The image forming apparatus according to claim 1, wherein the opening and closing detection unit includes an arm serving as the movable member that is pressed into the inside of the housing by contact with the entering portion, and a switch unit that outputs a signal corresponding to the open state and the closed state according to a position of the arm.

7. The image forming apparatus according to claim 1, wherein the environment detection unit detects temperature and/or humidity.

8. The image forming apparatus according to claim 1, wherein the entering portion is a protrusion provided on the opening and closing member.

9. The image forming apparatus according to claim 1, wherein the opening and closing detection unit and the environment detection unit are provided on a common electric circuit board provided inside the housing.

10. The image forming apparatus according to claim 1, wherein the control unit controls that image forming operation so that the image forming operation is not performed when the open state of the opening and closing member is detected by the opening and closing detection unit, and that the image forming operation is performed when the closed state of the opening and closing member is detected by the opening and closing detection unit.

* * * * *